United States Patent [19]

Whitwell et al.

[11] 4,120,170

[45] Oct. 17, 1978

[54] APPARATUS FOR REDUCING CONDENSATE NOISE IN AN AIR CONDITIONER

[75] Inventors: Robert J. Whitwell, Syracuse; Theodore S. Bolton, Liverpool, both of N.Y.

[73] Assignee: Carrier Corporation, Syracuse, N.Y.

[21] Appl. No.: 784,103

[22] Filed: Apr. 4, 1977

[51] Int. Cl.[2] ..... F25B 47/00

[52] U.S. Cl. ..... 62/91; 62/280; 261/91

[58] Field of Search ..... 62/280, 91; 261/90–92; 415/168

[56] References Cited

U.S. PATENT DOCUMENTS

| | | | |
|---|---|---|---|
| 2,678,810 | 5/1964 | Chandler | 261/92 |
| 3,191,401 | 6/1965 | Beyer et al. | 62/280 |
| 3,401,534 | 9/1968 | Marsteller | 62/280 |
| 3,766,751 | 10/1973 | Ball | 62/280 |
| 3,797,269 | 3/1974 | De Jarlais | 62/280 |
| 3,917,757 | 11/1975 | Hoag | 261/22 X |

*Primary Examiner*—William E. Wayner
*Assistant Examiner*—William E. Tapolcai, Jr.
*Attorney, Agent, or Firm*—J. Raymond Curtin; Robert P. Hayter

[57] ABSTRACT

Apparatus in an air conditioning unit for reducing noise created by a condensate slinger comprising a condenser fan shroud having contained as an integral part thereof a curvilinear baffle having a splash surface of a predetermined configuration closely surrounding the slinger for the purpose of reducing the noise attendant the delivery of the condensate collected adjacent to the slinger over the surface of a condenser.

7 Claims, 5 Drawing Figures

APPARATUS FOR REDUCING CONDENSATE NOISE IN AN AIR CONDITIONER

BACKGROUND OF THE INVENTION

1. Field of the Invention

The present invention relates to air conditioning units which are adapted to dispose of condensate by a slinger means. More specifically the present invention relates to apparatus for providing a curvilinear baffle having a splash surface to quietly receive condensate from the slinger.

2. Description of the Prior Art

Air conditioning units and especially the so-called self contained or room air conditioning units commonly used for residential applications generally include refrigeration circuits having an evaporator and a condenser. The air conditioning unit is usually divided by a partition into an evaporator section and a condenser section. The evaporation section is conventionally mounted to communicate with the air of the room which is to be supplied with conditioned air and the condenser section is usually mounted to communicate with the outside air for the discharge of heat. Contained within the evaporator section are an evaporator coil and an evaporator fan. Contained within the condenser section are a condenser coil and a condenser fan.

Refrigerant flows by means of a conventional circuit through the evaporator coil where it expands absorbing heat from the air flowing over it. The evaporator operates at a lower temperature than the room air being directed over the evaporator coil causing the air to be cooled. Since the temperature of the evaporator coil is normally below the dew point of air flowing thereover condensate forms on the evaporator coil surfaces.

The refrigeration circuit further includes the condenser coil. The refrigerant enters the condenser coil from the compressor at a high temperature in the form of refrigerant gas and discharges much of its heat to the outside air passing over the condenser coil so that the temperature of the refrigerant is greatly reduced and it leaves the condenser coil primarily in liquid form.

It has been determined that the condenser coil will be more efficient if in addition to the air passing thereover the condensate collected from the evaporator coil is also sprayed into the condenser coil. A slinger adapted to the condenser fan lifts the condensate into the condenser fan airstream where it is blown into the condenser coil and evaporated. This apparatus also serves to rid the unit of unwanted condensate. The use of a slinger is known and is the subject of U.S. Pat. No. 3,766,751 assigned to the assignee hereof.

In order to build less noisy air conditioning units it has been necessary to reduce the rate of rotation of the condenser and evaporator fans. Once this is done the condensate thrown by the slinger strikes the interior parts of the unit and causes undesirable noise. The present invention provides a curvilinear baffle having an annular splash surface as part of the condenser fan shroud. The splash surface is closely fitted to the slinger so the condensate strikes the splash surface at an acute angle reducing the noise previously caused by the impact of the condensate with the adjacent surface, either the wrapper or a fan shroud surface. Previous air conditioning units have employed fan shrouds on which the condensate has impinged. However, these previous fan shrouds neither contain a curvilinear baffle having a splash surface nor were they designed to reduce condensate noise by the provision of such a surface.

SUMMARY OF THE INVENTION

An object of the present invention is to reduce slinger condensate noise in self contained air conditioning units.

A more specific object of the present invention is to provide a splash surface in a room air conditioner to reduce slinger condensate noise.

A further object of the present invention is to provide as an integral part of a condenser fan shroud a curvilinear baffle having a splash surface to reduce slinger condensate noise.

A still further object of the present invention is to provide an economical, durable and easy to assemble means for reducing slinger condensate noise.

The preceding objects are achieved according to a preferred embodiment of the invention by the provision of a curvilinear baffle having a splash surface closely encircling the slinger in an air conditioning unit. The baffle is an integral part of the condenser fan shroud. The slinger attached to the condenser fan communicates with the evaporator condensate and lifts part of the condensate into the condenser fan air stream and throws part of the condensate against the splash surface at an acute angle. The noise occasioned by impact between the condensate and the splash surface is relatively quiet because of the acute angle of impact.

DESCRIPTION OF THE PREFERRED EMBODIMENT

The embodiment of the invention described below is for use in a self contained room air conditioner although it is to be understood that the invention could be utilized in other air conditioning units and in other devices where a fluid is forced into the air by means of a slinger such as a humidifier or vaporizer.

Figure 1:
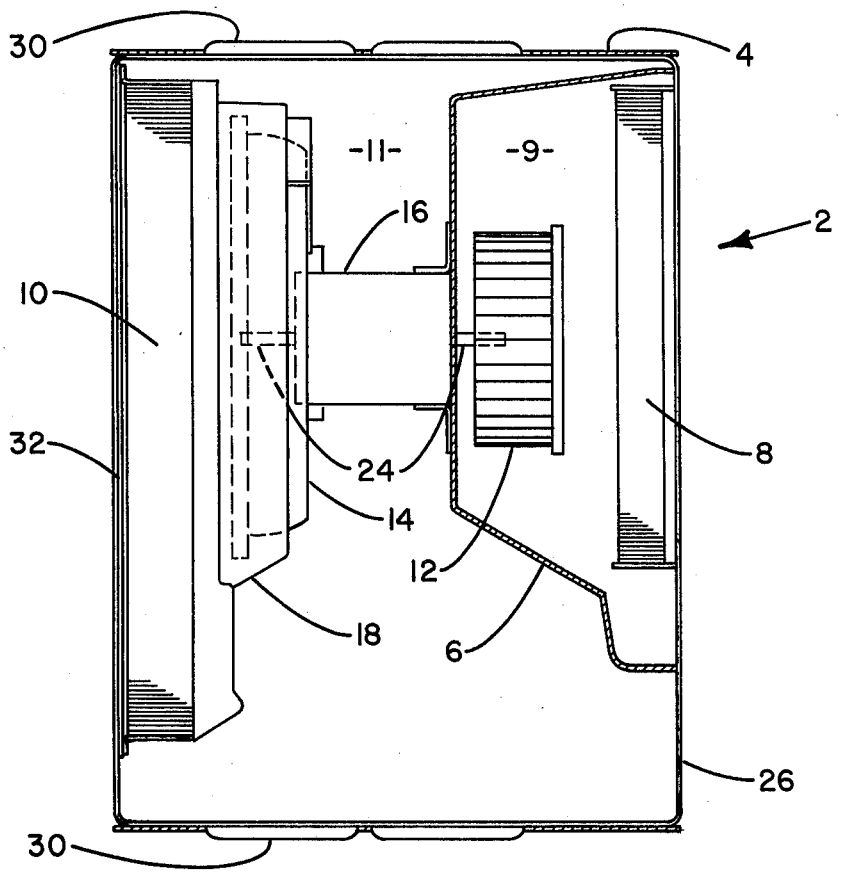
FIG. 1 is a partial schematic top view of a self contained room air conditioning unit illustrating the evaporator and condenser coils together with the fans for moving air thereover.
Figure 3:
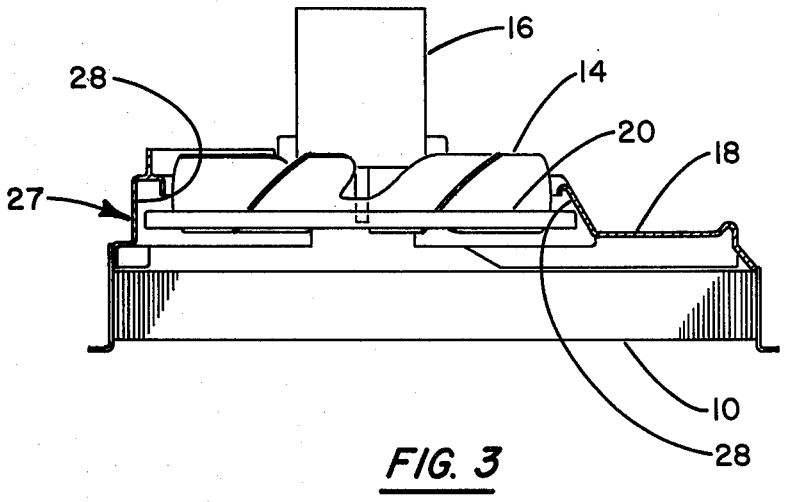
FIG. 3 is a top sectional view of the above at III—III.

Referring now to the drawings, FIG. 1 is a partial schematic top view of a self contained air conditioning unit showing some of the components. The air conditioner unit 2 is divided by partition 6 into evaporator section 9 containing evaporator coil 8 and evaporator fan 12 and into condenser section 11 containing condenser coil 10, condenser fan 14 and electric motor 16. Also contained in the condenser section are vents 30 for allowing outside air into condenser section 11, condenser shroud 18 and discharge area 32.

A room air conditioning unit is mounted with the the evaporator section in communication with the room air which is to be conditioned and the condenser section in communication with outside air.

In a normal refrigeration cycle the refrigerant circulates between the condenser coil 10, the evaporator coil 8, a compressor (not shown) and an expansion control device (not shown). The refrigerant expands in the evaporator coil absorbing heat from the room air flowing thereover thereby reducing the air temperature. The evaporator coil temperature is normally below the dew point temperature of the room air being drawn thereover by evaporator fan 12. Condensate from the water contained in the air is formed on evaporator coil 8 and said condensate is collected in base pan 26.

The function of condenser coil 10 is to cool the hot compressed refrigerant coming from the compressor. To achieve this cooling outside air is induced through vents 30 into condenser section 11 by condenser fan 14 which is powered by motor 16. The outside air is then guided by condenser fan shroud 18 over condenser coil 10 and out of the unit thru discharge area 32.

Mounted on condenser fan 14 is slinger 20 consisting of a solid ring of material attached to the tips of the fan blades forming a cylindrical band thereon. Shaft 24 is the axis of rotation of both fan 14 and slinger 20.

The condensate from evaporator coil 8 is collected in base pan 26 which extends from evaporator section 9 into condenser section 11. Sluiceways (not shown) in partition 6 allow the condensate to move from the evaporator section to the condenser section. Slinger 20, being in contact with the collected condensate in base pan 26, is rotated by the action of motor 16 thru shaft 24 on condenser fan 14. As the slinger is rotated part of the condensate is thrown into the airstream and blown directly into condenser coil 10 to aid in the removal of heat from the refrigerant. Another part of the condensate is thrown from the slinger ring in droplet form in a direction perpendicular to a radius extending from the axis to the slinger edge at the point the droplet leaves the slinger. These droplets strike an interior surface of the air conditioning unit and are recollected in base pan 26.

A condenser fan shroud 18 made of a plastic material encases condenser fan 14 and acts as an air flow barrier to define a path between air entering the condenser section thru vents 30 and the air being discharged from the condenser section thru discharge area 32. Comprising an integral part of condenser fan shroud 18 is curvilinear baffle 27 having a splash surface 28, which is closely fitted to slinger 20.

Figure 4:
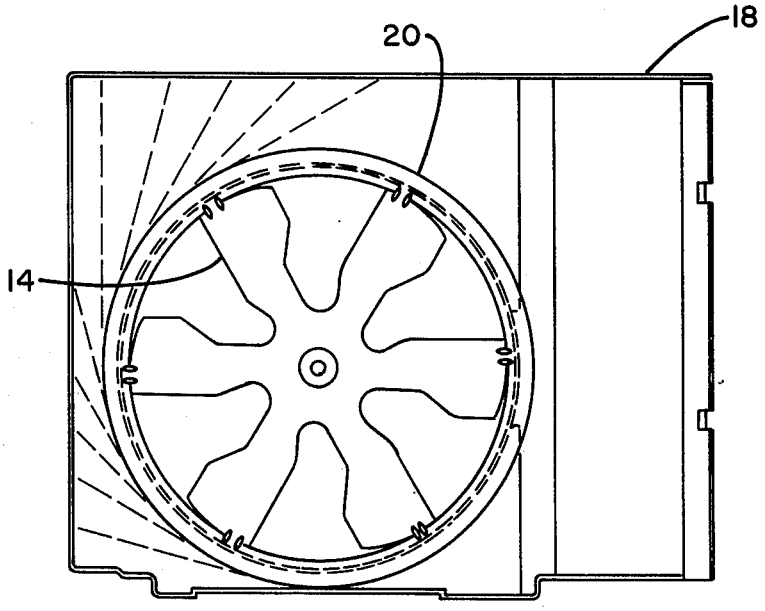
FIG. 4 (PRIOR ART)
FIG. 4 is a pictorial view of condensate travel from the slinger ring without the invention.
Figure 5:
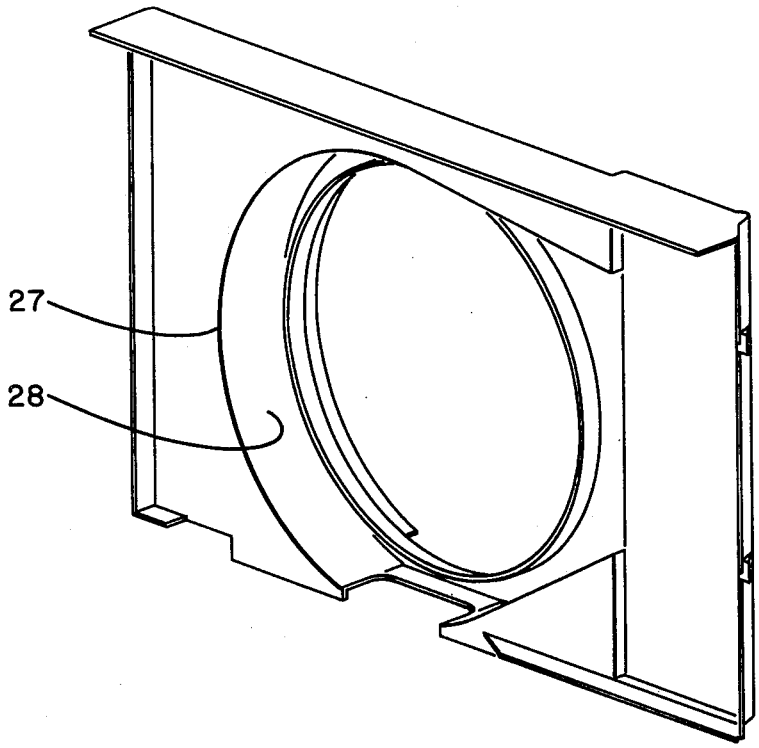
FIG. 5 is a perspective view of the condenser fan shroud showing the curvilinear baffle having the splash surface.

FIG. 4 (prior art) depicts the path of condensate droplets as they are thrown from slinger 20 without a splash surface. The path of the droplets is perpendicular to the interior walls of the unit in two areas causing considerable noise upon impact.

Figure 2:
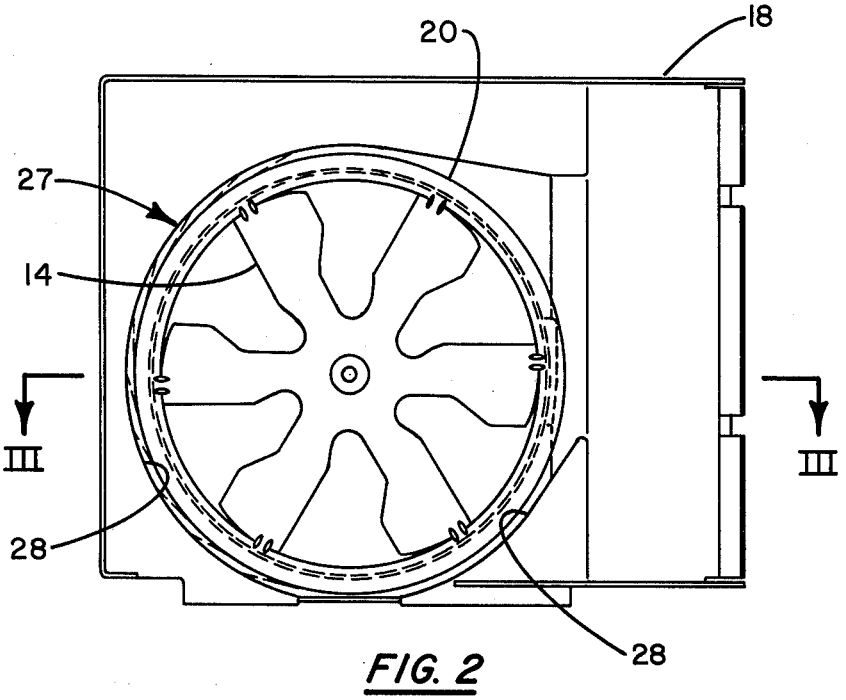
FIG. 2 is a partial elevational view of the condenser fan, slinger and condenser fan shroud of the invention and also showing by dotted lines the path of the condensate thrown from the slinger.

FIG. 2 depicts the change in the path and angle of impact of the condensate droplets by the use of splash surface 28. Therein at all times the droplets strike the splash surface at acute angles with correspondingly less direct impact with the splash surface and less noise.

From the above description of the preferred embodiment it is obvious that the invention provides an economical, effective and easy to manufacture means for reducing condensate noise.

The invention has been described in detail with particular reference to a preferred embodiment thereof, but it will be understood that variations and modifications can be effected within the spirit and scope of the invention.

We claim:

1. Apparatus in an air conditioning unit for reducing condensate noise which comprises:

an evaporator section wherein condensate is formed;

a condenser section having an axial condenser fan;

means for powering the fan;

fluid transfer means, whereby condensate is transferred from the evaporator section of the unit to the condenser section of the unit;

slinger means communicating with the condensate in the condenser section of the unit; and a condenser fan shroud encasing the condenser fan having an orifice acting as an air flow guide and further having a curvilinear baffle forming a splash surface closely fitted to the slinger means whereby the splash surface is provided so that the condensate thrown by the slinger means strikes the splash surface at an acute angle.

2. Apparatus as set forth in claim 1 wherein the fluid transfer means comprises a base pan connecting the evaporator section with the condenser section of the unit.

3. Apparatus as set forth in claim 2 wherein the slinger means comprises a cylindrical band mounted on the condenser fan blades, the axis of rotation of the slinger being the same as the axis of rotation of the condenser fan, whereby the cylindrical band contacts the collected condensate in the base pan and as a result of its rotation therewith sprays part of the condensate into the airstream of the fan and part against the splash surface.

4. Apparatus as set forth in claim 1 wherein the curvilinear baffle having a splash surface is in an integral part of the condenser fan shroud.

5. A method for reducing operating noise in an air conditioning unit having an evaporator section where condensation is formed, a condenser section having an axial condenser fan and having means for powering the fan which comprises:

transferring the condensation from the evaporator section of the unit to the condenser section of the unit;

slinging the condensation from the condenser section of the unit into the condenser fan air stream;

encasing the axial condenser fan with a condenser fan shroud defining a condenser fan orifice which acts as an air flow guide; and enclosing the means for slinging the condensation with a closely spaced curvilinear baffle having a splash surface which the condensate impacts at an acute angle.

6. The method as set forth in claim 5 which further comprises:

guiding the airflow created by the condenser fan by mounting a condenser fan shroud with an orifice to encase the condenser fan and having apparatus as an integral part of the fan shroud for the step of enclosing the means for slinging the condensate against a closely spaced curvilinear baffle having a splash surface.

7. Apparatus for reducing operating noise in a machine wherein fluid is mechanically thrown into an air stream which comprises:

a fluid transfer means to provide fluid to the machine;

a slinger means communicating with the fluid in the machine;

an axial fan means for providing an air stream; and a fan shroud defining an orifice co-acting with the axial fan for guiding air flow and having as an integral part thereof a curvilinear baffle having a splash surface closely surrounding the slinger means, whereby a splash surface is provided so that fluid thrown by the slinger means strikes the splash surface at an acute angle.

* * * * *